US012102146B2

(12) United States Patent
Johnson

(10) Patent No.: US 12,102,146 B2
(45) Date of Patent: Oct. 1, 2024

(54) UTILITY GLOVE WITH RETENTION FEATURE

(71) Applicant: Robert Johnson, Tucker, GA (US)

(72) Inventor: Robert Johnson, Tucker, GA (US)

( * ) Notice: Subject to any disclaimer, the term of this patent is extended or adjusted under 35 U.S.C. 154(b) by 45 days.

(21) Appl. No.: 17/337,060

(22) Filed: Jun. 2, 2021

(65) Prior Publication Data

US 2021/0368895 A1 Dec. 2, 2021

Related U.S. Application Data

(60) Provisional application No. 63/033,469, filed on Jun. 2, 2020.

(51) Int. Cl.
*A41D 19/00* (2006.01)

(52) U.S. Cl.
CPC ..... *A41D 19/0037* (2013.01)

(58) Field of Classification Search
CPC ..... A41D 19/0024; A41D 19/0037
USPC ..... 2/160
See application file for complete search history.

(56) References Cited

U.S. PATENT DOCUMENTS 1,309,150 A * 7/1919 Monfort ..... A45F 5/02 2/160
3,170,703 A * 2/1965 Marchand ..... A41D 19/0041 2/160
5,365,609 A * 11/1994 Herzog ..... A45F 5/02 2/160
6,360,928 B1 * 3/2002 Russo ..... A45F 5/00 24/3.2
6,519,776 B1 * 2/2003 Davenport ..... A63B 57/207 2/161.1
6,973,674 B2 12/2005 Jackson, Jr.
7,257,865 B2 * 8/2007 Kaneko ..... F16G 11/101 24/115 G
7,334,711 B1 * 2/2008 Winters ..... H04B 1/385 224/217
7,529,155 B2 * 5/2009 Fasciano ..... G04G 21/00 368/10
7,686,740 B1 * 3/2010 Chang ..... A63B 21/0608 482/50
7,942,293 B2 * 5/2011 Lawrence ..... A45C 11/008 29/257
8,328,055 B1 * 12/2012 Snyder ..... A45F 5/00 224/267
8,464,364 B2 * 6/2013 Hofeldt ..... A41D 19/01523 2/160
8,510,866 B2 * 8/2013 Mizumoto ..... A41F 1/06 2/161.2
8,584,916 B1 * 11/2013 Chen ..... A45F 5/021 224/904

(Continued)

*Primary Examiner* — Richale L Quinn
(74) *Attorney, Agent, or Firm* — Ballard Spahr LLP

(57) ABSTRACT

A utility glove including a retention assembly, the glove being configured to be worn on a hand of a user and having a body portion including a palm covering and a dorsal covering, the body portion defining a wrist opening and a plurality of digit apertures, and a retainer assembly having a base portion disposed on an outer surface of the dorsal covering, the base portion including a body portion defining a circular aperture, and a platform portion that is rotatably disposed within the circular aperture of the base portion and includes a retention portion for selectively retaining items thereon.

6 Claims, 15 Drawing Sheets

(56) References Cited

U.S. PATENT DOCUMENTS 8,662,362 B1 * 3/2014 Bastian ..... H04B 1/385 248/205.2
8,676,279 B2 * 3/2014 McCurdy ..... A45F 5/00 455/575.6
8,936,222 B1 * 1/2015 Bastian ..... A45F 5/00 224/183
9,072,364 B2 * 7/2015 Johnson ..... F16M 13/027
9,137,915 B2 * 9/2015 McCurdy ..... H05K 5/03
9,164,126 B1 * 10/2015 Rodda ..... G01R 1/04
9,366,383 B2 * 6/2016 Chien ..... F16M 11/16
9,529,388 B1 * 12/2016 Mchatet ..... F16M 13/00
9,551,915 B2 * 1/2017 Clearman ..... F16M 11/041
9,773,601 B2 * 9/2017 Breiwa ..... H02J 7/0042
9,869,423 B2 * 1/2018 Khodapanah ..... F16M 11/2021
9,869,976 B2 * 1/2018 Perko ..... G04B 37/1486
9,876,524 B1 * 1/2018 Motilall ..... F16M 13/00
9,929,765 B2 * 3/2018 Williams ..... A45F 5/00
9,943,159 B1 * 4/2018 Novikova ..... A45D 40/22
9,948,340 B2 * 4/2018 Shin ..... H04B 1/385
9,954,569 B2 * 4/2018 Murphy ..... F16M 11/40
10,066,779 B2 * 9/2018 Vogel ..... F16M 13/00
10,152,028 B2 * 12/2018 Kim ..... G04G 21/08
10,172,399 B1 * 1/2019 Rivers ..... A41D 19/0024
10,271,634 B1 * 4/2019 Eynav ..... A45F 5/021
10,317,845 B2 * 6/2019 Zhang ..... A44C 5/00
10,320,062 B2 * 6/2019 Kozakai ..... H01Q 1/273
10,344,924 B1 * 7/2019 Ganahl ..... F21V 15/04
10,383,379 B2 * 8/2019 Hollo ..... H04B 1/385
10,551,012 B2 * 2/2020 Schorr, III ..... F21L 4/005
10,568,410 B2 * 2/2020 Pierson ..... F16M 13/04
10,633,787 B1 * 4/2020 Pham ..... D06F 95/008
10,712,127 B2 * 7/2020 Tedder ..... B60R 7/14
11,147,362 B2 * 10/2021 Eynav ..... A45F 5/14
11,299,106 B2 * 4/2022 Navarro ..... B60R 11/0247
11,441,725 B2 * 9/2022 Vogel ..... F16B 1/00
11,516,328 B2 * 11/2022 Adelman ..... F16M 13/02
11,606,988 B2 * 3/2023 Zvak ..... A41D 19/002
11,607,030 B1 * 3/2023 Bell ..... A45F 5/02
2006/0196902 A1 * 9/2006 Chen ..... A45F 5/021 224/669
2007/0099469 A1 * 5/2007 Sorensen ..... A45F 5/02 439/289
2008/0083797 A1 * 4/2008 Myers ..... A45C 13/20 224/217
2009/0039121 A1 * 2/2009 Paul ..... A44C 5/0007 224/191
2010/0327030 A1 * 12/2010 Yang ..... A45F 5/00 224/199
2012/0080462 A1 * 4/2012 Hajarian ..... A45F 5/00 224/219
2012/0138647 A1 * 6/2012 Norling ..... F16M 11/2014 224/267
2013/0091617 A1 * 4/2013 Elias ..... A41D 19/0024 2/160
2013/0295549 A1 * 11/2013 Hills ..... A45F 5/00 434/379
2013/0300141 A1 * 11/2013 Byrne ..... A45F 5/00 294/25
2015/0052660 A1 * 2/2015 Chapman ..... A45F 5/00 2/160
2016/0036950 A1 * 2/2016 Keesling ..... A45F 5/00 455/575.6
2017/0179995 A1 * 6/2017 Oviedo ..... A45C 11/00
2018/0295908 A1 * 10/2018 Hollo ..... A45F 5/02
2019/0000164 A1 * 1/2019 Oviedo ..... A41D 19/0013
2020/0323332 A1 * 10/2020 Pierson ..... H04B 1/385
2021/0021917 A1 * 1/2021 Holland ..... H04R 1/026
2021/0307433 A1 * 10/2021 Hollo ..... A45F 5/02
2021/0368895 A1 * 12/2021 Johnson ..... A41D 19/0037
2022/0225708 A1 * 7/2022 Javed ..... A41D 19/002
2023/0161410 A1 * 5/2023 Ward ..... A41D 19/0027 345/156

* cited by examiner

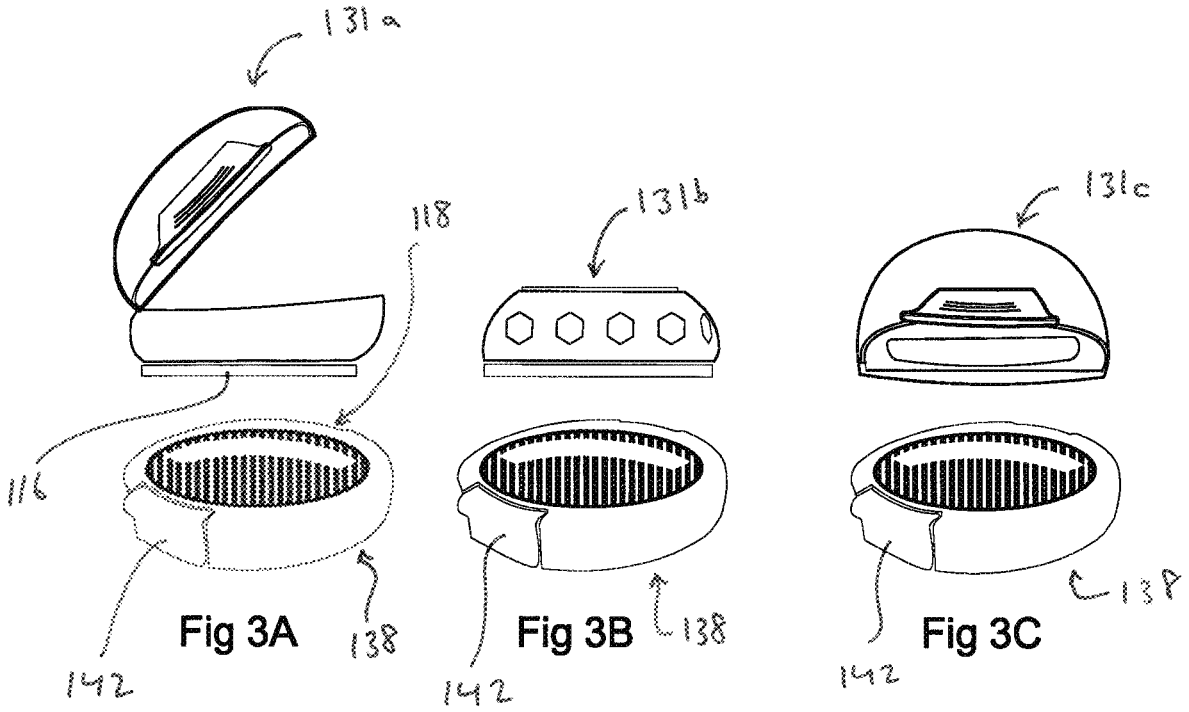
Fig 3A
Fig 3B
Fig 3C
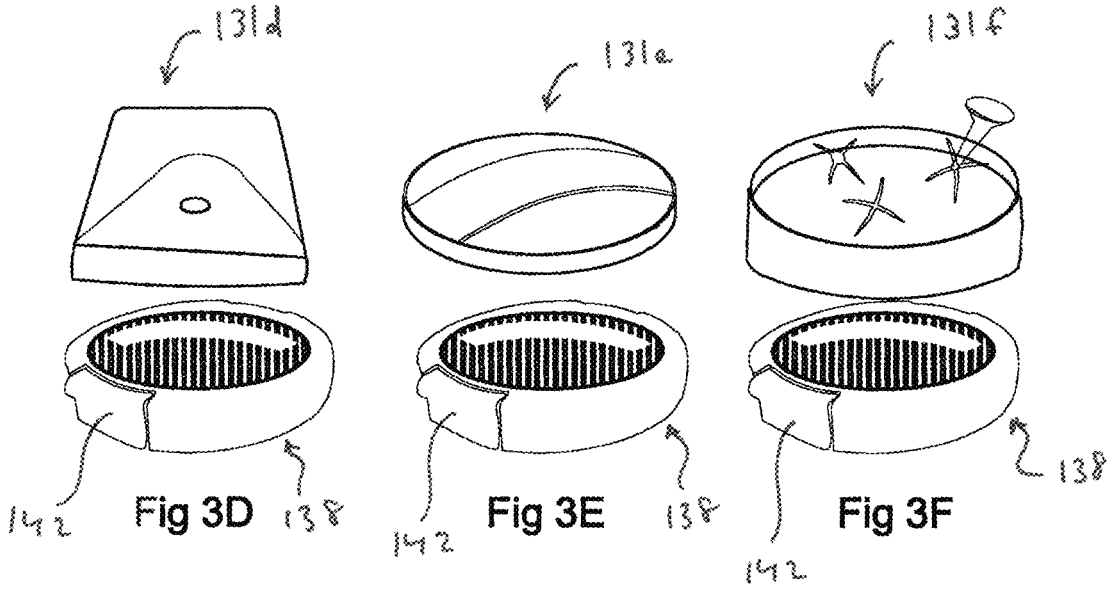
Fig 3D
Fig 3E
Fig 3F

UTILITY GLOVE WITH RETENTION FEATURE

CLAIM OF PRIORITY

This application claims priority to U.S. Provisional Application No. 63/033,469, filed Jun. 2, 2020, the entire disclosure of which is incorporated by reference herein.

FIELD OF THE INVENTION

The present invention relates generally to hand coverings and, more particularly, to gloves including retention features for holding items on the gloves while worn by a user.

BACKGROUND OF THE INVENTION

Many glove wearers often have items that they utilize to carry out tasks. These items may often be small to medium size tools, instruments, parts and/or other items such as could be used in a variety of industries that implement service, fabrication, construction, etc. Parts and/or items are often stored near the user, in an apron, a bag, carrier, or resting on a surface. Although the items may be in close proximity to the user, the user has the extra task of retrieving those items when working on a project. Often the user's hands are away from the body and, as well, away from the items that he desires to utilize. Therefore, the user may be inconvenienced by reaching, repositioning himself, or having to stop working in order to gather the items which are needed to proceed with executing the job. Other users may not be able to carry such items in hand or find it inconvenient to carry a bag, box, etc., around for such items.

The present invention recognizes and addresses considerations of prior art constructions and methods.

SUMMARY OF THE INVENTION

One embodiment of the present disclosure provides a utility glove including a retention assembly, the glove being configured to be worn on a hand of a user and having a body portion including a palm covering and a dorsal covering, the body portion defining a wrist opening and a plurality of digit apertures, and a retainer assembly having a base portion disposed on an outer surface of the dorsal covering, the base portion including a body portion defining a circular aperture, and a platform portion that is rotatably disposed within the circular aperture of the base portion and includes a retention portion for selectively retaining items thereon.

Another embodiment provides a glove including a retention assembly, the glove being configured to be worn on a hand of a user and having a body portion including a palm covering and a dorsal covering, the body portion defining a wrist opening and a plurality of digit apertures, and a retention assembly including a base portion disposed on an outer surface of the dorsal covering, the base portion defining a semi-spherical recess therein, and a retention assembly including a semi-spherical projection and a retention portion, wherein the semi-spherical projection is selectively receivably within the semi-spherical recess.

Yet another embodiment provides a hand covering including a retention assembly, the hand covering being configured to be worn on a hand of a user and having a body portion including a palm covering and a dorsal covering, and a retention assembly including a mount portion disposed on an outer surface of the dorsal covering, the base portion that is selectively attachable to the mount portion, an extended member having a first end and a second end, the first end being pivotably attached to the base portion, and a platform portion that is pivotably attached to the second end of the elongated member and includes a retention portion for selectively retaining items thereon.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which;

FIGS. 3A through 3F are views of retention features of the retention assembly of the utility glove shown in FIGS. 1A and 1B;

Figure 1A:
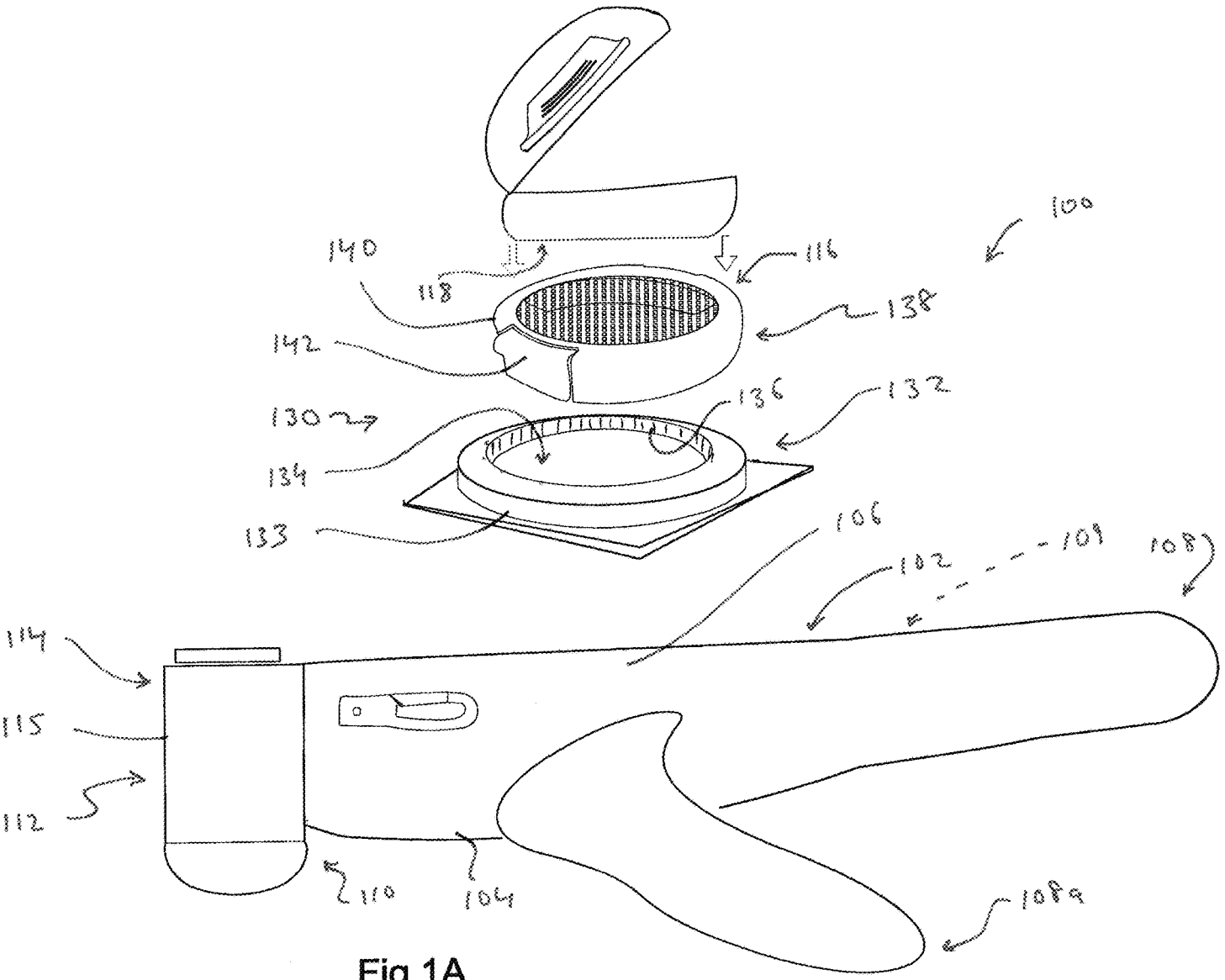
FIGS. 1A and 1B are a side view and a top view, respectively, of an embodiment of a utility glove in accordance with the present invention.

Repeat use of reference characters in the present specification and drawings is intended to represent same or analogous features or elements of the invention according to the disclosure.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used herein, terms referring to a direction or a position relative to the orientation of the utility glove, such as but not limited to "vertical," "horizontal," "top," "bottom," "above," or "below," refer to directions and relative positions with respect to the utility glove's orientation shown in FIG. 1A. Thus, for instance, the terms "vertical" and "top" refer to the vertical orientation and relative upper position in the perspective of FIG. 1A, and should be understood in that context, even with respect to a utility glove that may be disposed in a different orientation.

Further, the term "or" as used in this application and the appended claims is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "and" as used in this application and the appended claims should generally be construed to mean "one or more" unless specified otherwise or clear from the context to be directed to a singular form. Throughout the specification and claims, the following terms takes at least the meanings explicitly associated herein, unless the context dictates otherwise. The meanings identified below do not necessarily limit the terms, but merely provide illustrative examples for the terms. The meaning of "a," "and," and "the" may include plural references, and the meaning of "in" may include "in" and "on." The phrase "in one embodiment," as used herein, does not necessarily refer to the same embodiment, although it may.

Referring now to the drawings 1A and 1B, a hand covering, specifically a utility glove 100 in accordance with the invention includes a body portion 102 formed by a dorsal covering 106 and a ventral (palm) covering 104, a plurality of digit sleeves 108, one of which is a thumb sleeve 108*a*, and a closure assembly 114 disposed on a wrist portion 110 adjacent a wrist opening 112 of the body portion 102. Closure assembly 114 is preferably formed by a strip of loop fastening material (not shown) attached to a bottom surface of a closure flap 115 that is selectively attached with a strip of hook fasting material (not shown) that is attached to the dorsal covering 106 of the body portion 102. A retention assembly 130 is centrally disposed on the dorsal covering 106 of the body portion 102 as well.

Figure 4B:
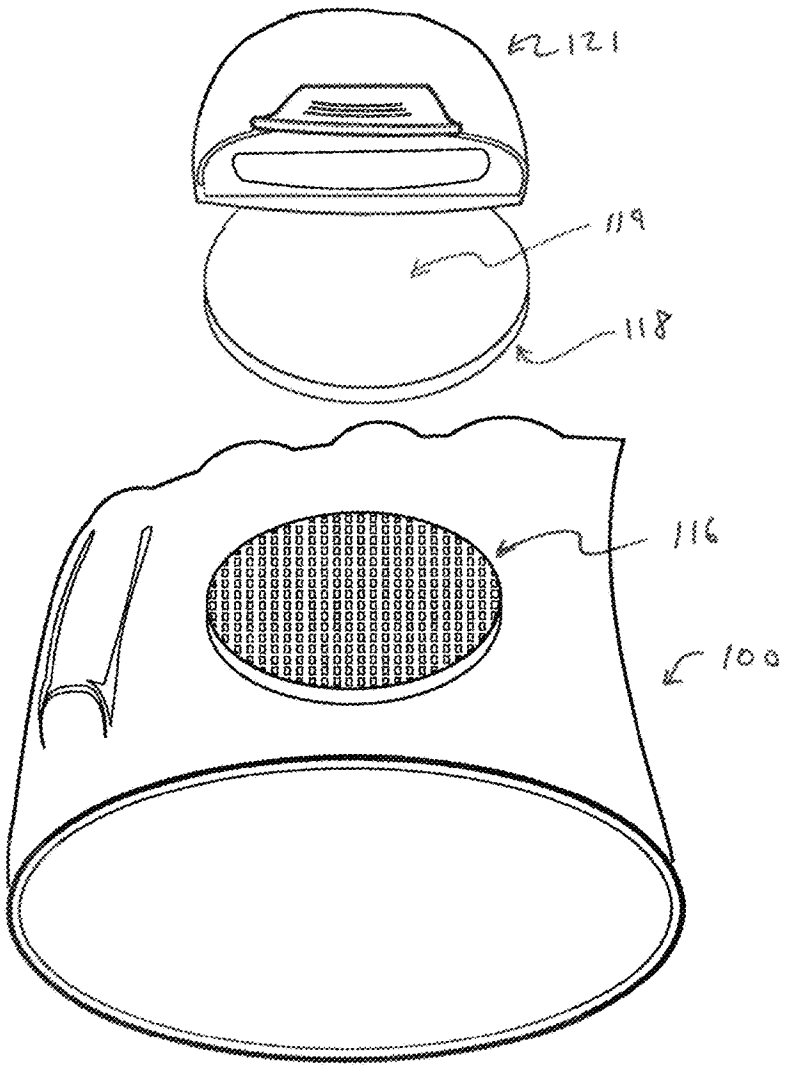
FIGS. 4A and 4B are perspective views of an alternate embodiment of a utility glove in accordance with the present invention.
Figure 4A:
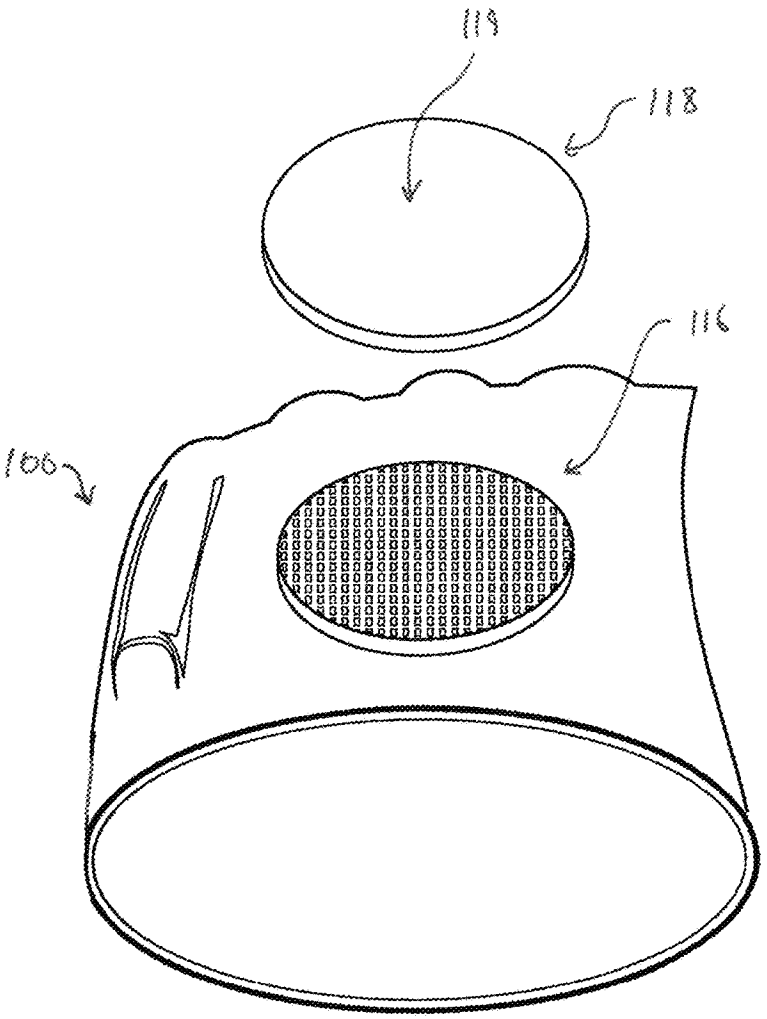

Utility glove 100 is of flexible construction, preferably formed of material such as, but not limited to cotton, polyester, non-flammable material, leather, latex, etc., and may be perforated with ventilation holes on the dorsal surfaces. In alternate embodiments, both dorsal and ventral surfaces are perforated depending upon the intended usage of the glove. In other alternate embodiments, the dorsal and ventral surfaces of the glove 100 may be constructed of differing materials. As shown in dashed lines on FIGS. 1A and 1B, the body portion 102 defines a plurality of digit sleeve openings 109 to which the digit sleeves 108 extend. In alternate embodiments, one or more digit sleeves 108 may be omitted. Additionally, utility glove 100 preferably includes a wrist pouch 160 for receiving small items, a magnetic strip 162, a clip 166, and as best seen in FIGS. 4A and 4B, a pencil slot 164 for slidably receiving a pencil or other elongated object therein.

Figure 1B:
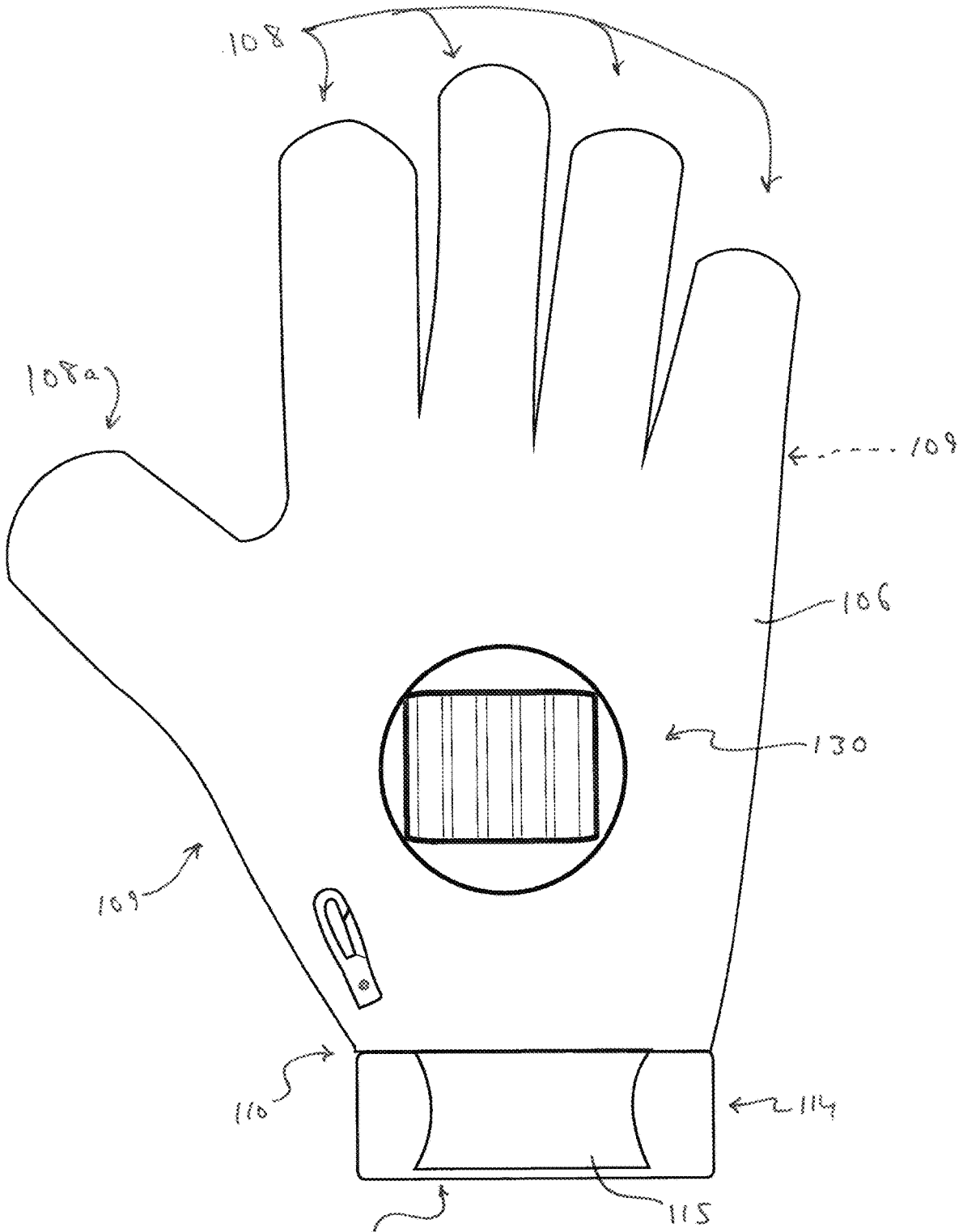
Figure 2A:
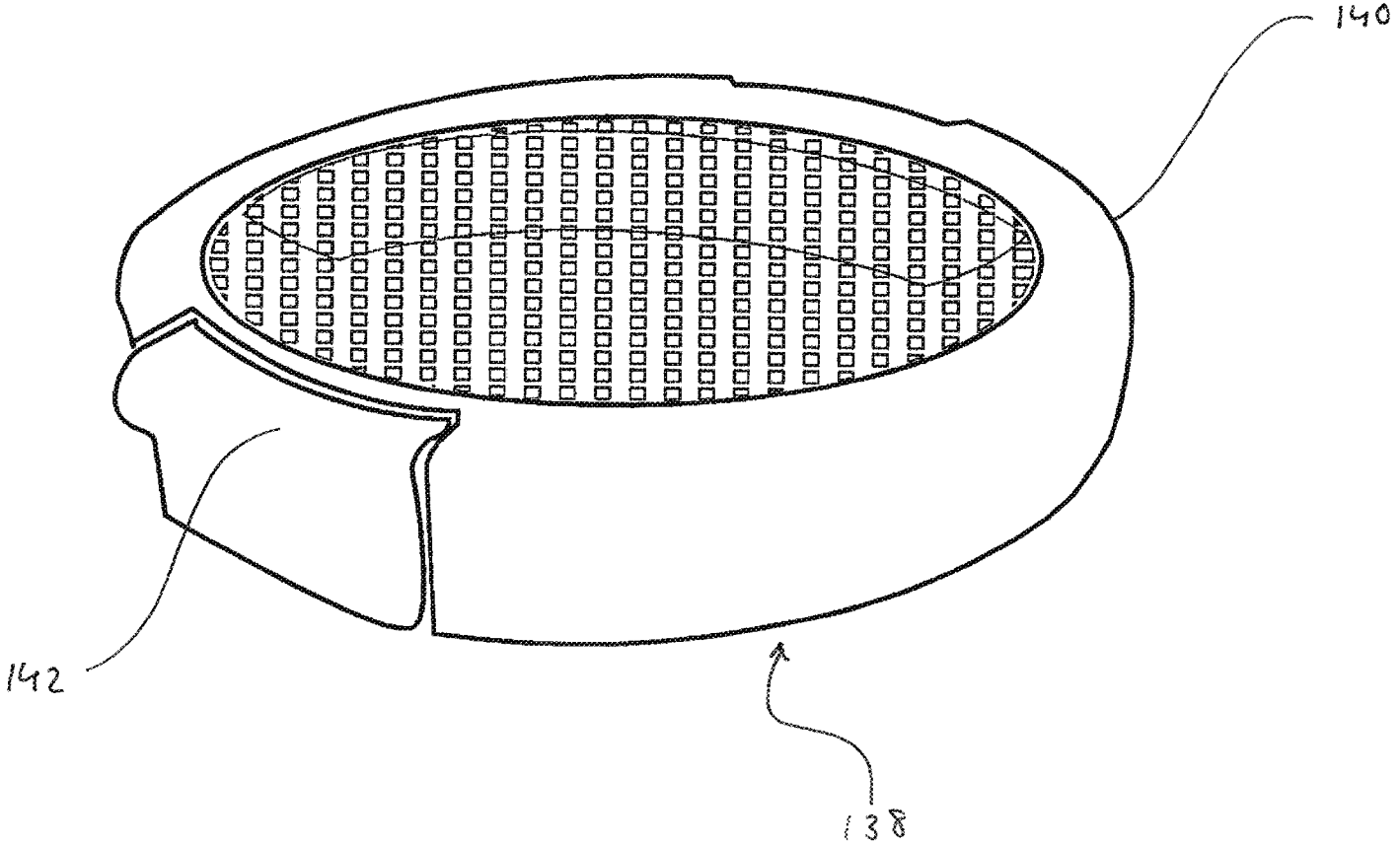
FIGS. 2A, 2B, and 2C are views of a platform of the retention assembly of the utility glove shown in FIGS. 1A and 1B.
Figure 2C:
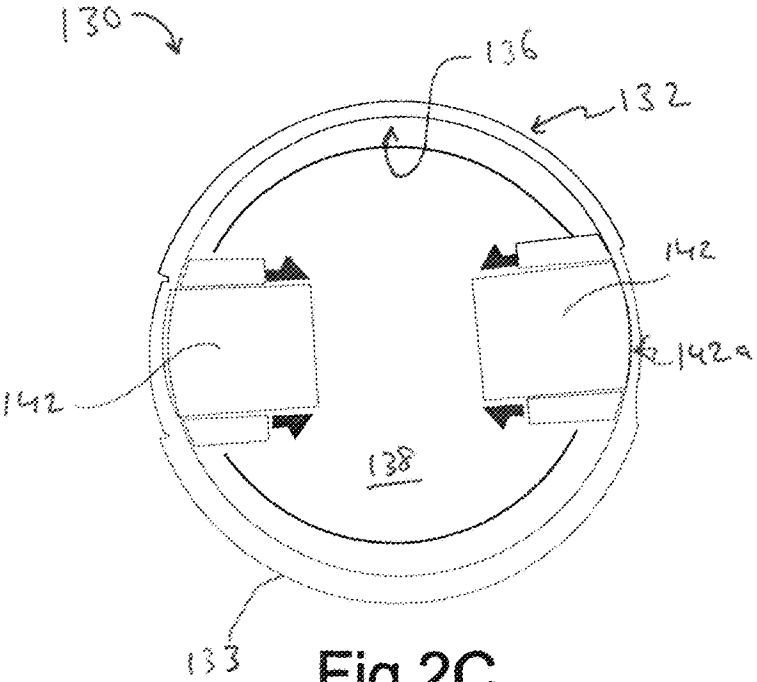
Figure 2B:
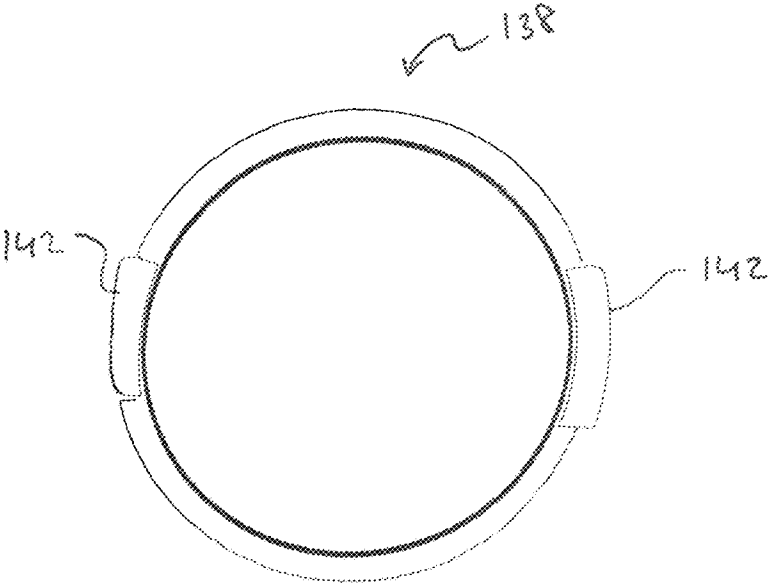

Still referring to FIGS. 1A and 1B, a preferred embodiment of utility glove 100 includes a retention assembly 130 that is configured to retain small tools, various items, etc., on the dorsal covering 106 of the glove. As best shown in FIG. 1A, the retention assembly 130 includes a base 132 and a platform 138 that is received therein. Referring additionally to FIGS. 2A through 2C, the base 132 includes a body 133 that defines an aperture 134 (FIG. 8) therein, and an annular groove 136 formed on the inner wall thereof. The platform 138 includes a cylindrical body 140 and a pair of tabs 142 extending radially outwardly from an outer cylindrical wall of the platform's body 140. In the example shown, the base 132 of the retention assembly 130 is secured to the upper surface of the dorsal covering 106 by stitching. Note, however, in alternate embodiments the base 132 could be secured to the dorsal covering 106 by adhesives, hook and loop fastening material, magnetic attraction between a magnet secured to the dorsal covering 106 of the glove and a ferrous material on a bottom surface of the base 132, etc.

Figure 8:
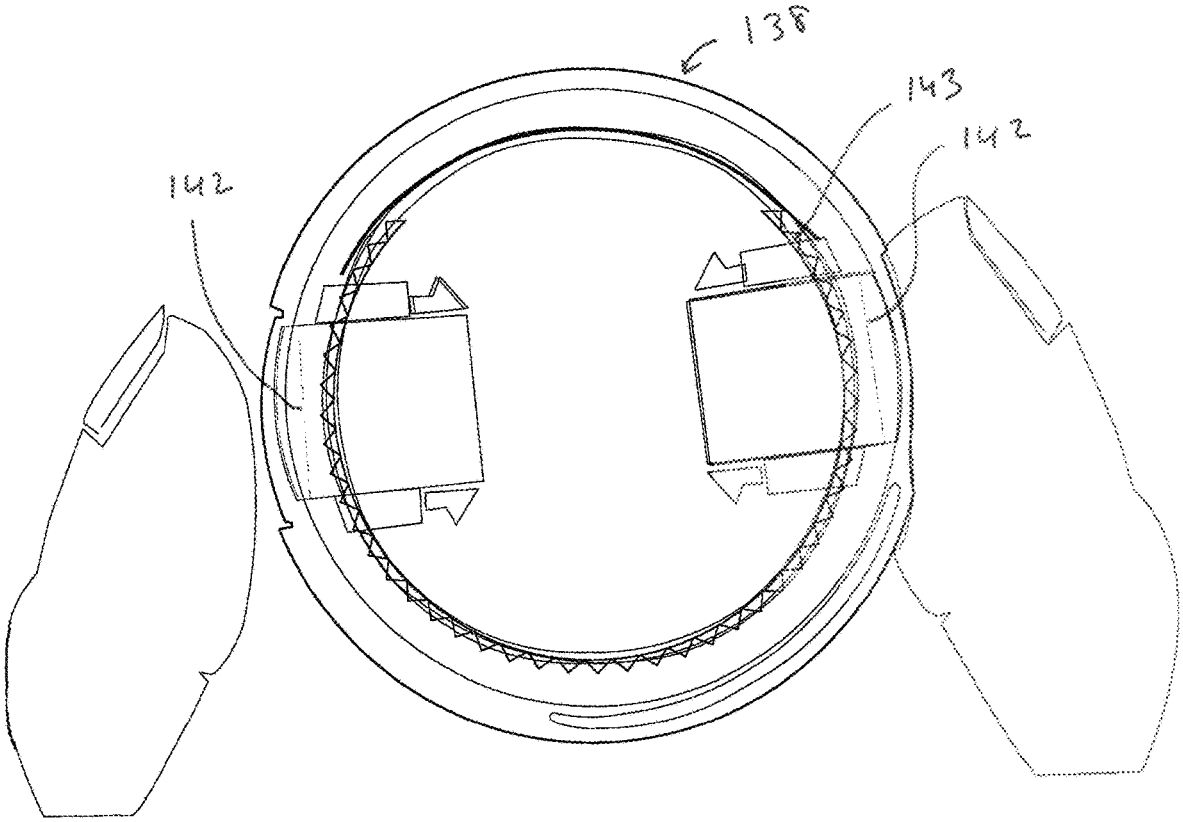
FIG. 8 is a view of an alternate embodiment of a retention assembly for a utility glove in accordance with the present invention.
Figure 8:
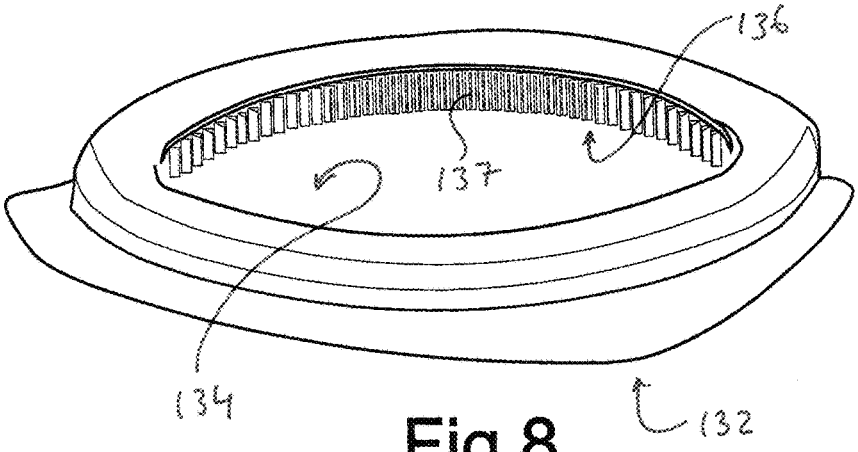

Preferably, the tabs 142 of the platform 138 of the retention assembly 132 are spring-loaded radially-outwardly therefrom, as shown in FIGS. 2A through 2C. To attach a platform 138 to the base 132, the user pushes tabs 142 radially-inwardly (FIG. 2C) and inserts the body 140 fully into the aperture 134 defined by the base 132. Once in position, the user releases the inward force on the tabs 142, thereby allowing the distal ends 142*a* to extend radially-outwardly until they are received in annular groove 136 of base, thereby securing the platform 138 to the base 132. Additionally, as the annular groove 136 of the base 132 is continuous, the platform 138 is freely rotatable within the base 132. As shown in FIG. 8, in alternate embodiments the annular groove 136 may include a plurality of teeth 137 that are configured to receive a plurality of a correspondingly-shaped teeth 143 disposed on the distal ends of tabs 142. As such, the platform 138 is no longer freely rotatable with respect to base 132, but is rotatable in a ratcheting manner. Note, in some embodiments the teeth may be shaped such that the base 132 is rotatable in a ratcheting fashion with respect to base without operation of the tabs 142 by the user, whereas they may also be shaped such that the tabs must be depressed radially-inwardly to rotate the platform 138, thereby forming a locking feature.

Referring now to FIGS. 3A through 3F, the platform 138 may be utilized to retain numerous retention features including, but not limited to, a clam shell feature 131*a* (FIG. 3A), a slide holder 131*b* (FIG. 3B) including a plurality of variously shaped bores, a pouch 131*c* (FIG. 3C), a pocket 131*d* (FIG. 5D), an elastic strap 131*e* (FIG. 3E), foam pad including slits 131*f* (FIG. 3F), etc. These various retention features 131*a* through 131*f* may be configured dependent upon the type of tools, small items, etc., which the user desires to store therein. As shown in FIGS. 3A through 3F, retention features 131*a* through 131*f* are retained on the platform 138 by hook fastening material 116 that selectively engages loop fastening material 118 disposed on the upper surface of the platform 138. Alternately, the retention feature 131*a* through 131*f* could be selectively attached to the platform 138 by magnetic attraction between a magnet and a ferrous material, by correspondingly-formed threads on the retention features and a top surface of the platform 138, by a snap feature, by correspondingly-aligned grooves and ribs, etc. As well, as shown in FIGS. 4A and 4B, hook fastening material 116 may be secured, such as by stitching, directly to the glove 100, and a magnetic/ferrous pad 119 may be selectively geared thereto by loop fastening material 118. A retention feature 121 (FIG. 4B) may be selectively attached thereto by utilizing magnetic attraction.

Figure 5A:
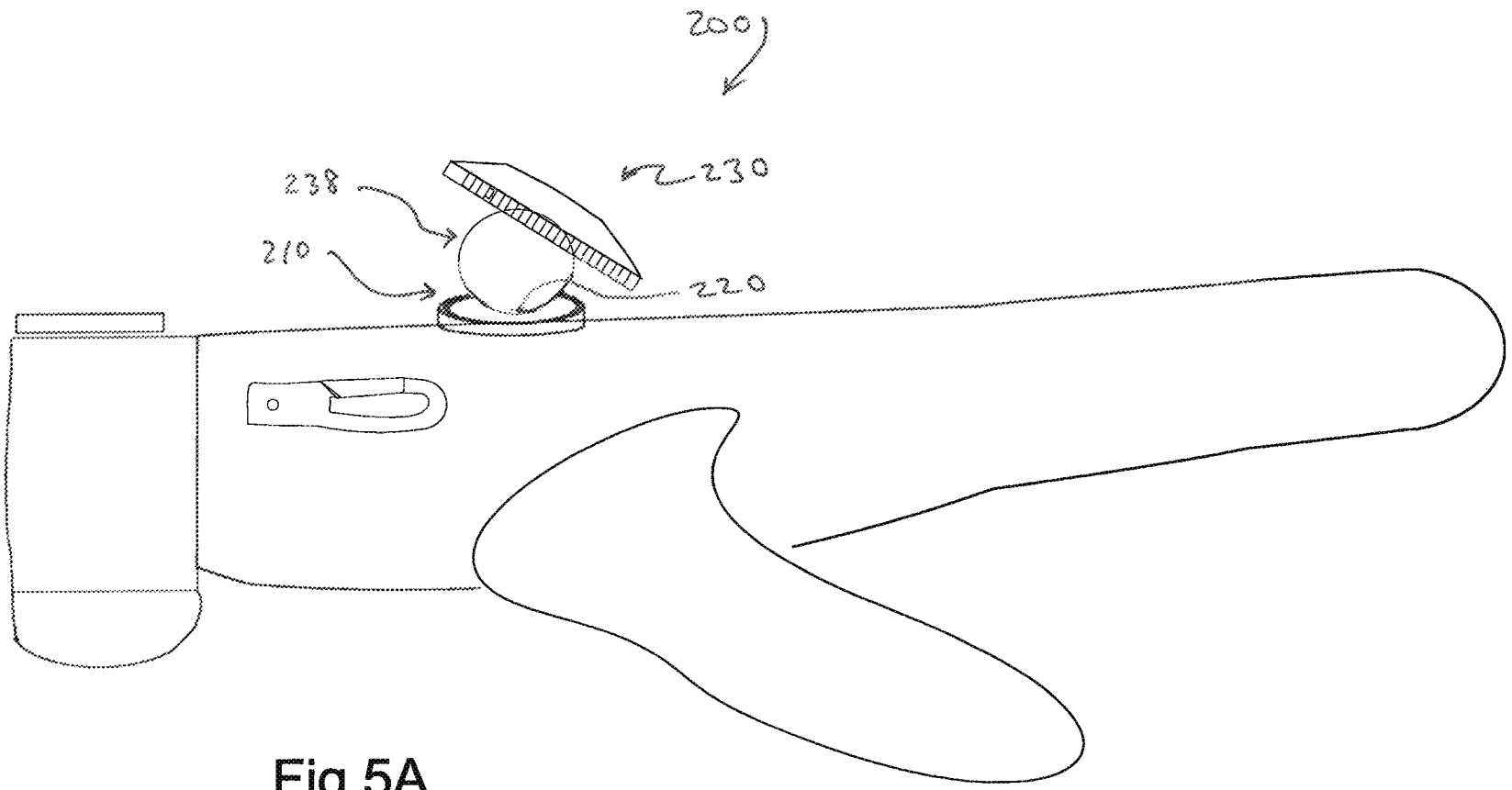
FIGS. 5A and 5B are various views of an attachment assembly of the utility glove shown in FIG. 1.
Figure 5B:
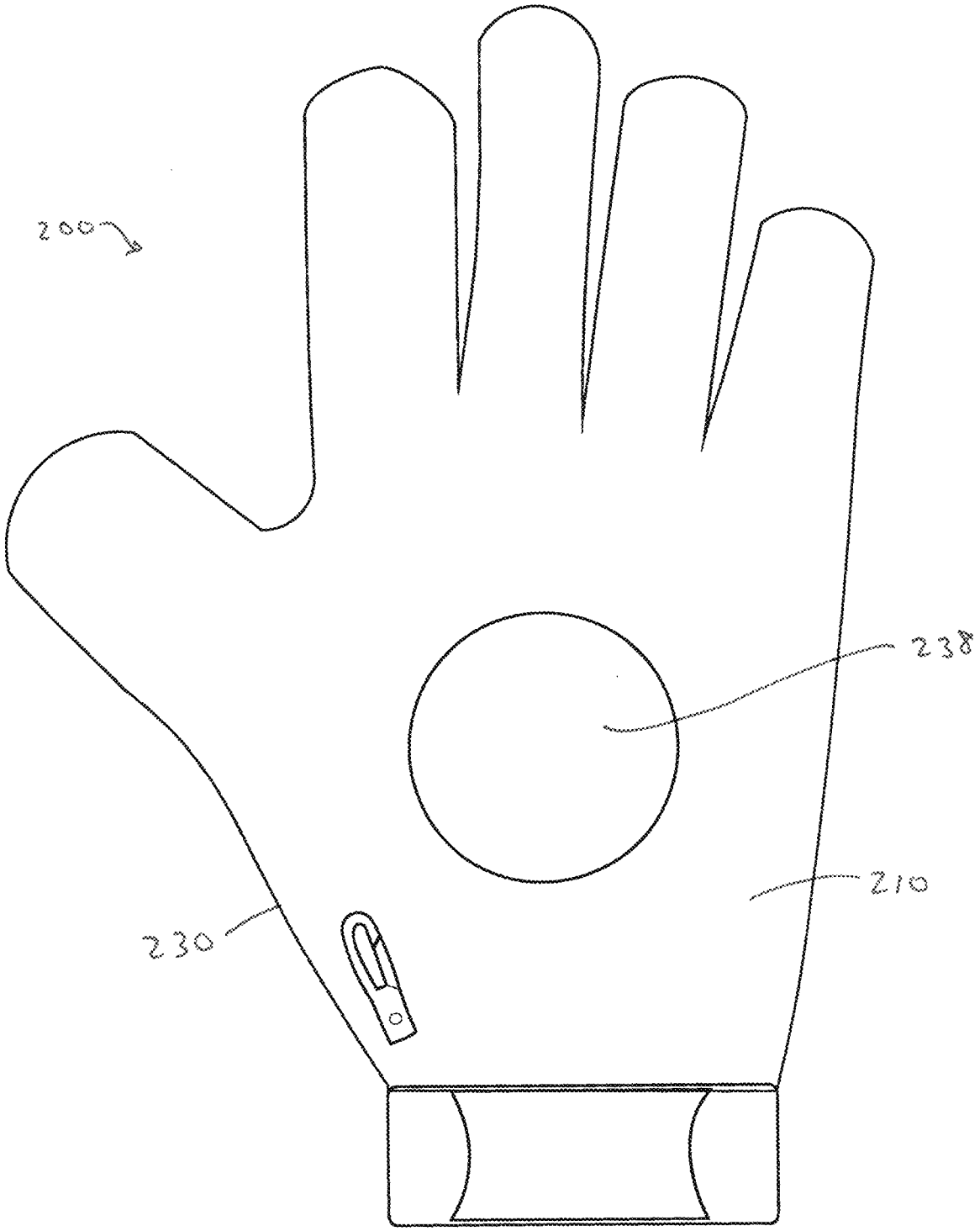

Referring now to FIGS. 5A and 5B, an alternate embodiment of utility glove 200 is constructed almost identically to the first embodiment of the utility glove 100, as described above, with the exception of the retention assembly 230. As shown, the retention assembly 230 of utility glove 200 includes a magnetic base 210 that defines an upwardly facing semi-spherical shaped recess 220. The semi-spherical shaped surface 220 of the base 210 is configured to selectively receive a projection 238, such as a ball, that extends downwardly from a platform 250 having a correspondingly-shaped outer surface to that of semi-spherical surface 220. Preferably, projection 238 is formed of a ferrous material so that it is attracted to the magnetic base 210. Note, however, in alternate embodiments the base 210 may be formed of a ferrous material whereas the projection 238 of platform 250 is formed of a magnetic material.

Figure 6A:
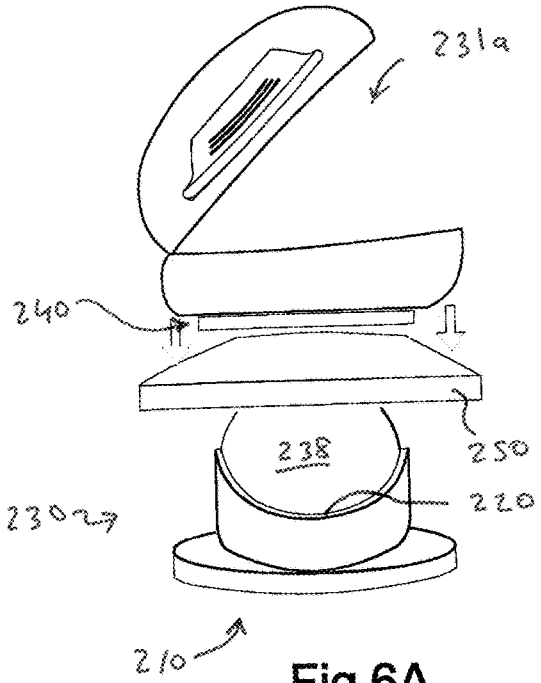
FIGS. 6A through 6D are various views of retention features of the retention assembly shown in FIGS. 5A and 5B.
Figure 6B:
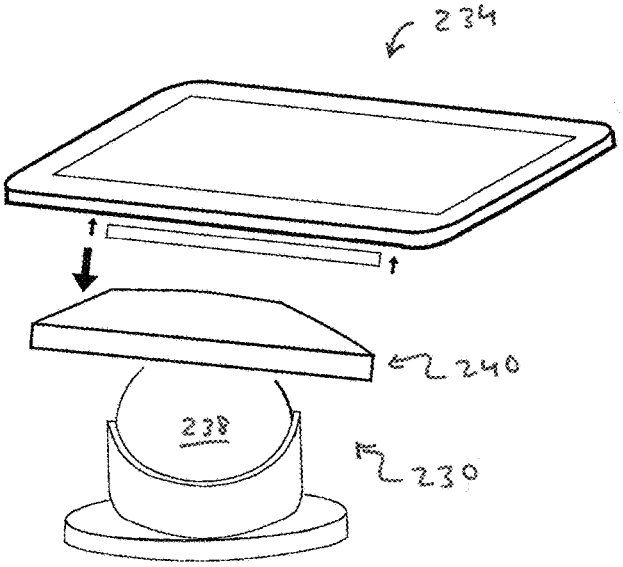
Figure 6C:
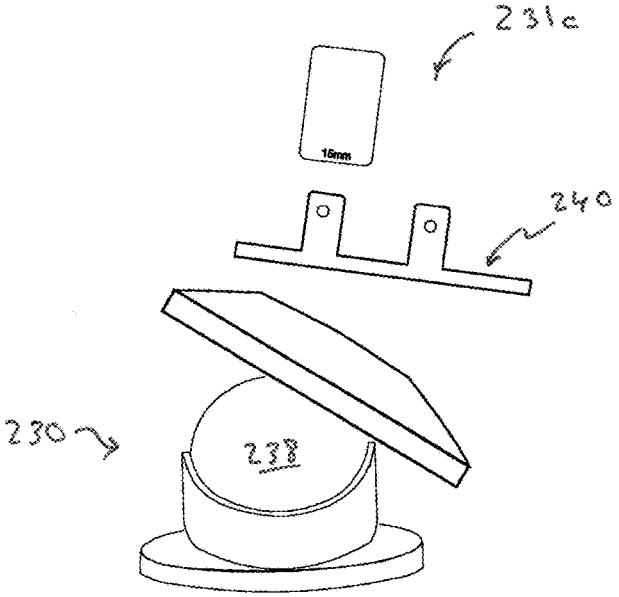
Figure 6D:
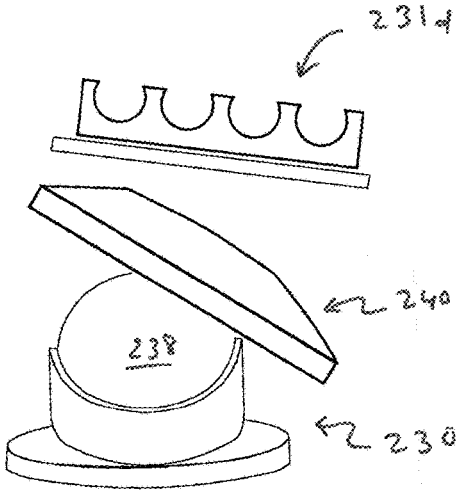

As best seen in FIGS. 6A through 6D, the platform 250 may be swiveled within base 210 to assist in positioning the platform 250 as desired. Preferably, the retention features 231*a* (FIG. 6A), in the form of a clam shell 231*c* (FIG. 6C) in the form of a socket holder, and 231*d* (FIG. 6D) in the form of a pen or bit clip, are removably secured to platform 250 by way of a magnetic plate 240 that is secured to the various retention features by adhesives, magnetic attraction, hook and loop fastening material, etc. Note, in alternate embodiments, the various retention features may be secured to the platform 250 by hook and loop fastening material, thereby allowing the magnetic plate 240 to be omitted. Note, as shown in FIG. 6B, items other than tools may be attached to the retention assembly 230, such as a cell phone 234. Other example items that may also be secured to retention assemblies 130 and 230 include, but are not limited to, military and policy equipment such as handcuffs, extra magazines, watches, flashlights, etc., medical instruments such as heart rate monitors, thermometers, stethoscopes, etc., and other items such as cameras, flexible LED light fixtures, an orbit mouse, a speaker, with various of these items including blue tooth technology.

Figure 7:
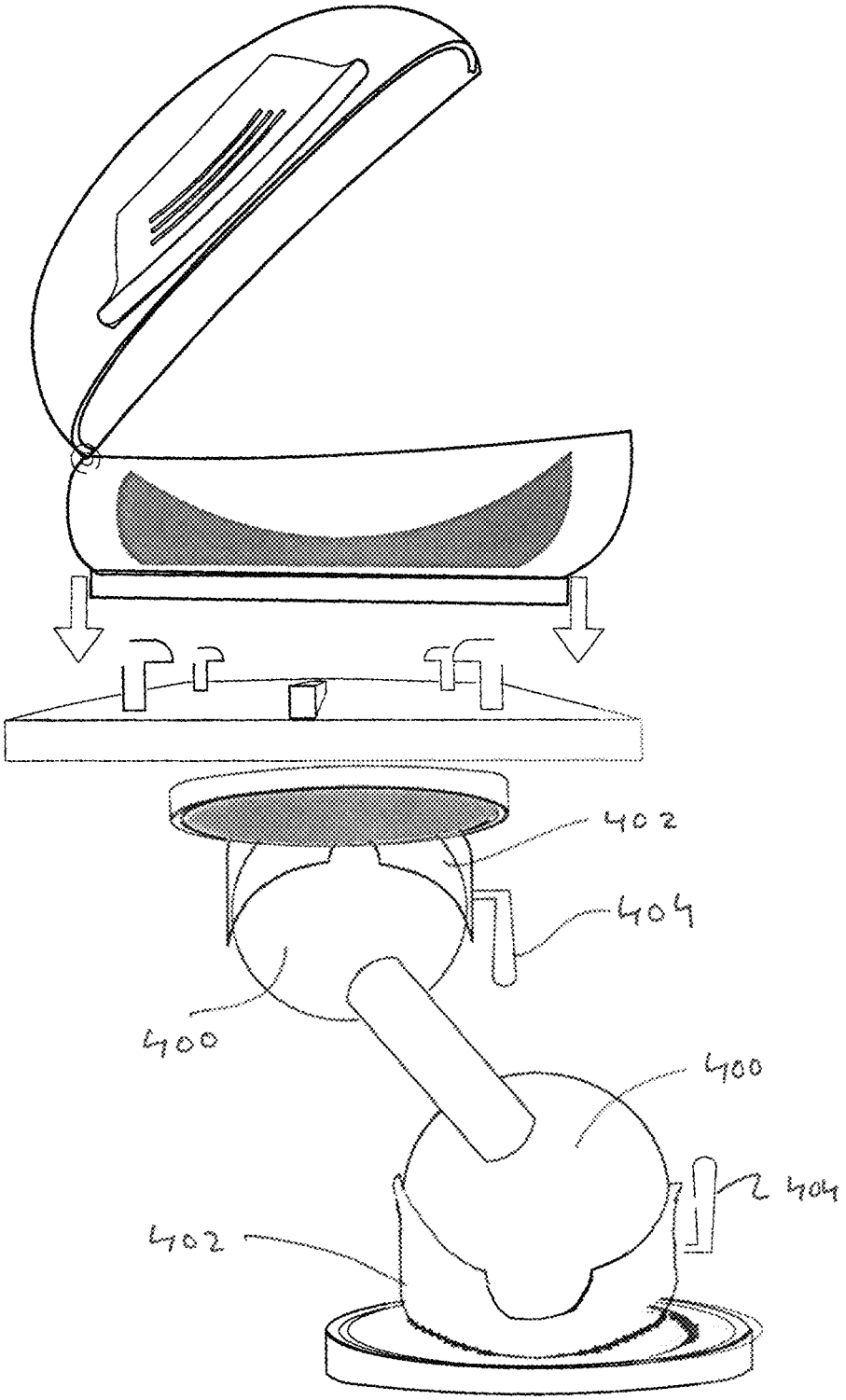
FIG. 7 is a view of an alternate embodiment of a retention assembly for a utility glove in accordance with the present invention.
Figure 9:
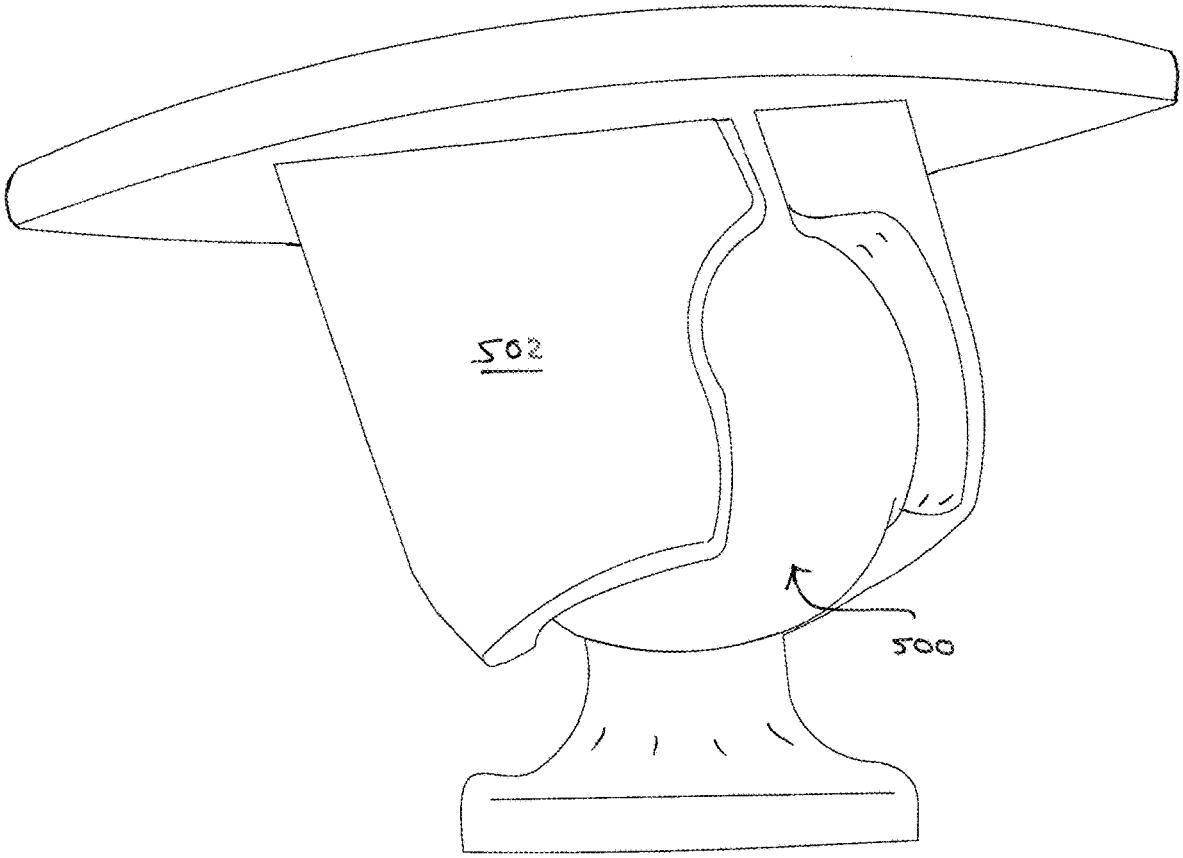
FIG. 9 is a view of a swivel attachment of an alternate embodiment of a utility glove in accordance with the present invention.

As shown in FIG. 7, a non-magnetic ball 400 and socket 402 may be utilized to attach items to the disclosed utility glove. Multiple ball and socket features allow for the items attached to the glove to be positioned in multiple configurations. As well, locking features 404 may be provided to prevent undesired motion of the objects relative to the glove. FIG. 9 shows a ball 500 and socket 502 assembly constructed of a polymer, metal, etc., wherein the balls of the socket 502 provide resistance to movement as they are constricted on the ball 500.

Figure 11B:
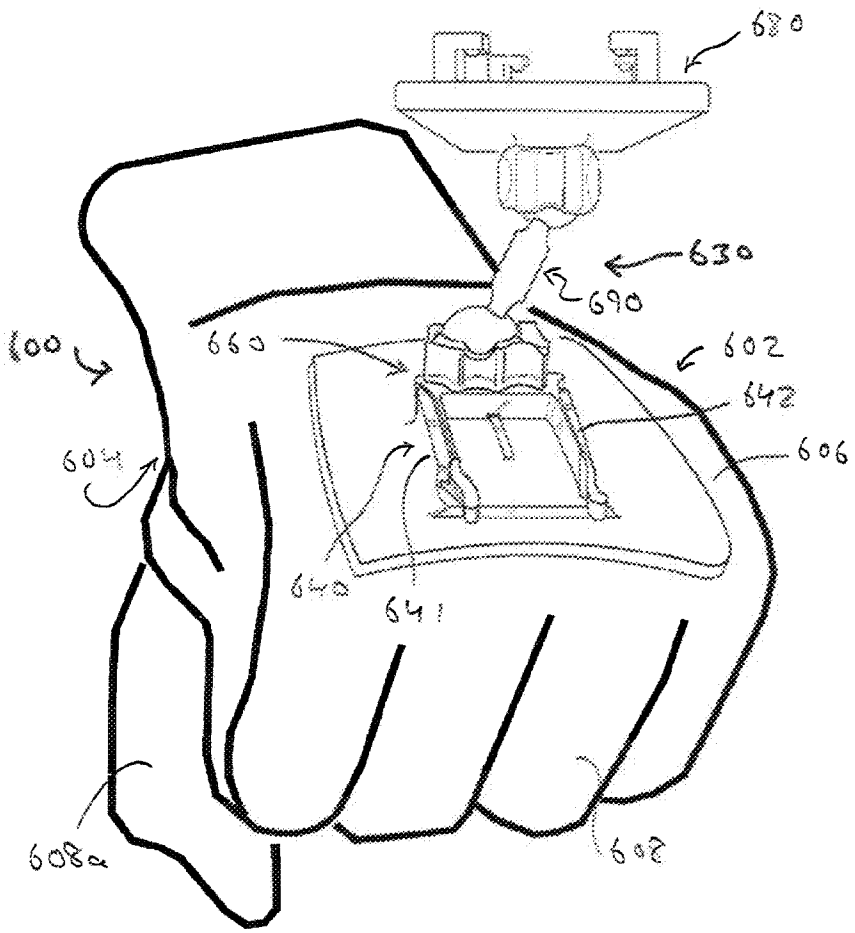
FIGS. 11A and 11B are perspective views of a utility glove for use with the retention assembly as shown in FIGS. 10A and 10B.
Figure 11A:
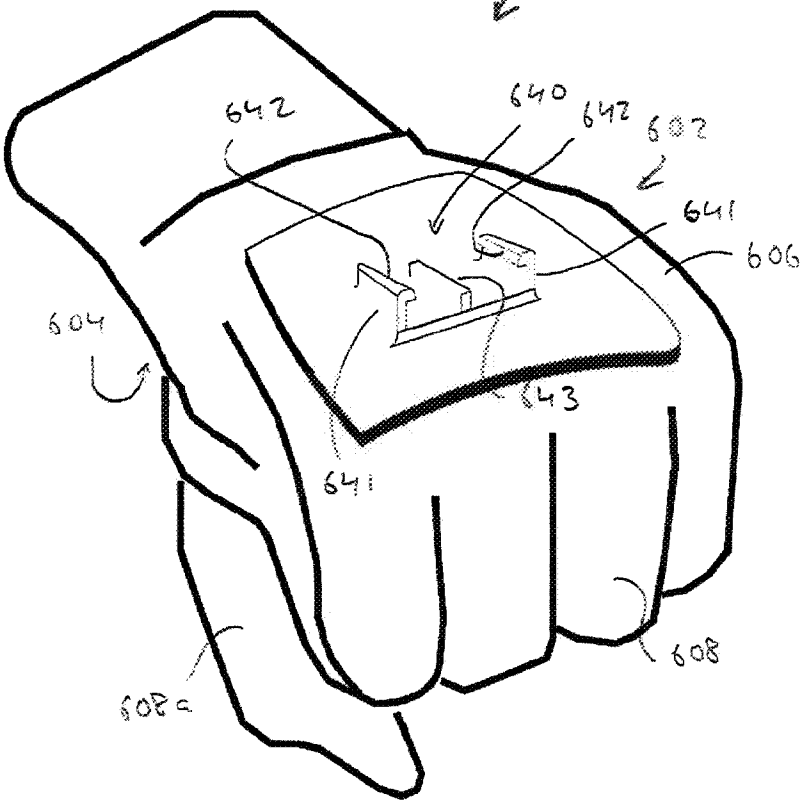

Referring now to FIGS. 11A and 11B, a utility glove 600 in accordance with an alternate embodiment of the invention includes a body portion 602 formed by a dorsal covering 606 and a ventral (palm) covering 604, a plurality of digit sleeves 608, one of which is a thumb sleeve 608*a*, and preferably a closure assembly (not shown) disposed on a wrist portion adjacent a wrist opening. The closure assembly is preferably formed by a strip of loop fastening material that is selectively attached with a strip of hook fasting material that is attached to the dorsal covering 606 of the body portion 602. A retention assembly 630 is centrally disposed on the dorsal covering 606 of the body portion 602 as well.

Preferably, the utility glove 600 is of flexible construction, formed of material such as, but not limited to cotton, polyester, non-flammable material, leather, latex, etc., and may be perforated with ventilation holes on the dorsal surfaces. In alternate embodiments, both dorsal and ventral surfaces are perforated depending upon the intended usage of the glove. In other alternate embodiments, the dorsal and ventral surfaces of the glove 600 may be constructed of differing materials.

Figure 10B:
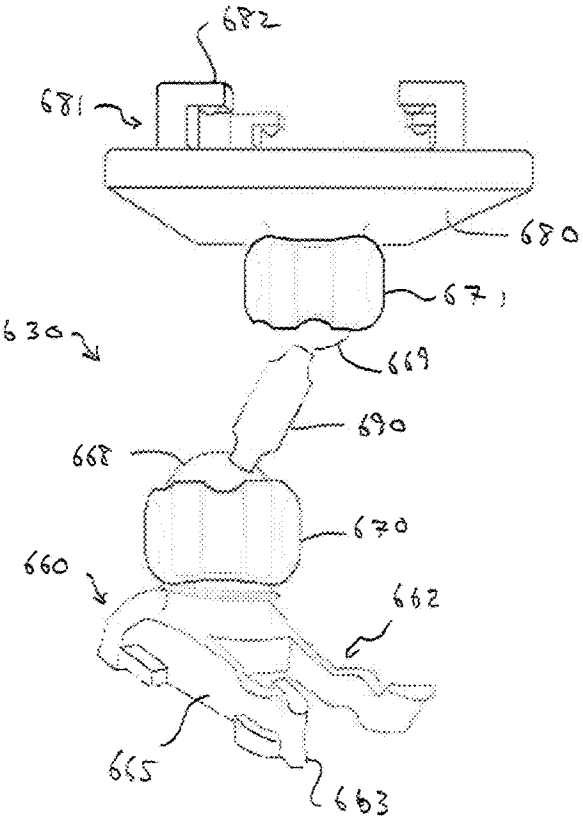
FIGS. 10A and 10B are an exploded perspective view and an assembled perspective view of an alternate embodiment of a retention assembly for a utility glove in accordance with the present invention.
Figure 10A:
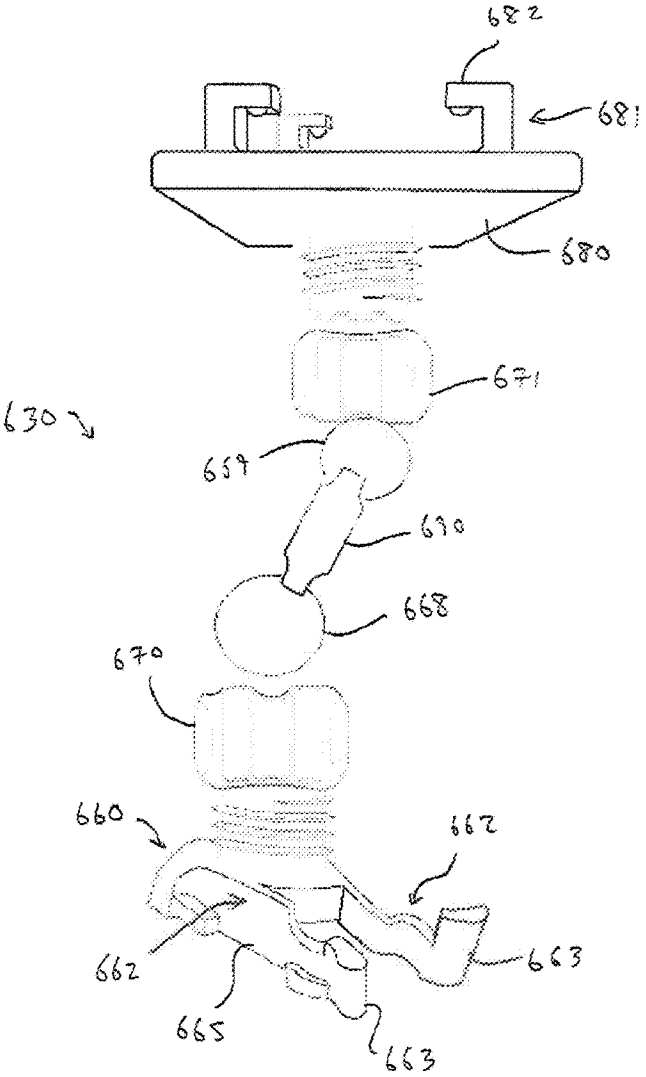

Referring additionally to FIGS. 10A and 10B, a preferred embodiment of utility glove 600 includes a retention assembly 630 that is configured to retain small tools, various items such as cameras, phones, etc., on the dorsal covering 606 of the glove. As best shown in FIG. 11A, the retention assembly 630 includes a mount 640, and a base 660 including a platform 680 that is pivotably mounted thereto by an elongated member 690. In the example shown, the mount 640 of the retention assembly 630 is secured to the upper surface of the dorsal covering 606 by stitching. Note, however, in alternate embodiments the base 132 could be secured to the dorsal covering 606 by adhesives, hook and loop fastening material, magnetic attraction between a magnet secured to the dorsal covering 606 of the glove and a ferrous material on a bottom surface of the base 660, etc. As shown, the mount 640 includes a pair of substantially parallel walls 641, each including an inwardly depending elongated flange 642 extending along its top edge, as best seen in FIG. 11A. An abutment wall 643 is preferably disposed between eh parallel walls 641 to help secure the base 660 to the parallel walls 641 by limited relative motion with respect thereto, as discussed below.

As best seen in FIGS. 10A and 10B, the base 660 includes a substantially parallel tabs 662 that are attached to the base 660 at their proximal ends and are configured to be urged inwardly at their distal ends 663 by a user. Each tab 662 defines a recess 665 along its outer surface, each recess 665 being configured to selectively receive a corresponding one of the parallel walls 641 of the mount 640 therein, as discussed below.

Preferably, the base 660 includes a semi-spherical recess (not shown) but is configured to rotatably receive a mounting sphere 668 therein, the mounting sphere 668 being disposed at a first end of the elongated member 690 of the retention assembly 630. A threaded cap 670 may be used to secure the mounting sphere 668 of the elongated member 690 in the desired position with respect to the mount 640. Similarly, a mounting sphere 669 is also disposed at a second end of the elongated member 690 and secured in a corresponding semi-spherical recess (not shown) on a bottom surface of a platform 680 of the retention assembly 630. Similarly, the mounting sphere 669 can be secured in the desired position with respect to the platform 680 by a threaded cap 671.

Preferably, the tabs 662 of the base 660 of the retention assembly 630 are spring-loaded radially-outwardly therefrom. To attach the base 660 to the mount 64, the user pushes tabs 662 radially-inwardly and inserts the tabs 662 between the parallel walls 641 of the mount 640. Once in position, the user releases the inward force on the tabs 662, thereby allowing the distal ends 663 to extend radially-outwardly. In this position, with the base 640 also contacting the back end of the abutment wall 643, as shown in FIG. 11B, the parallel walls 641 are each received in a recess 665 of a corresponding tab 642, thereby securing the base 660 to the mount 640.

Figure 12B:
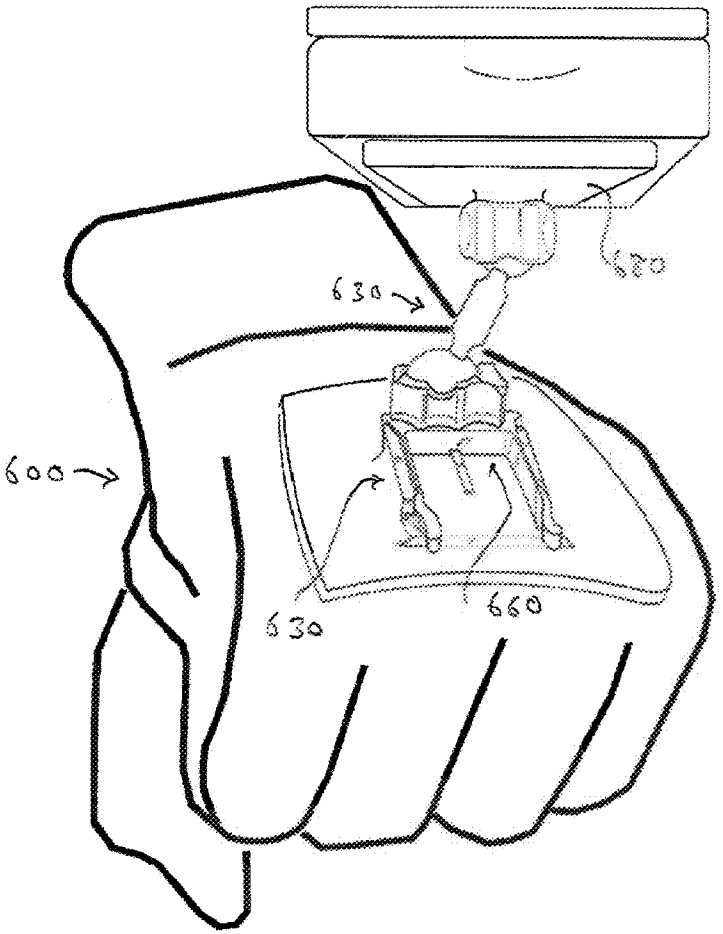
FIGS. 12A and 12B are perspective views of retention features of the retention assembly shown in FIGS. 10A and 10B.
Figure 12A:
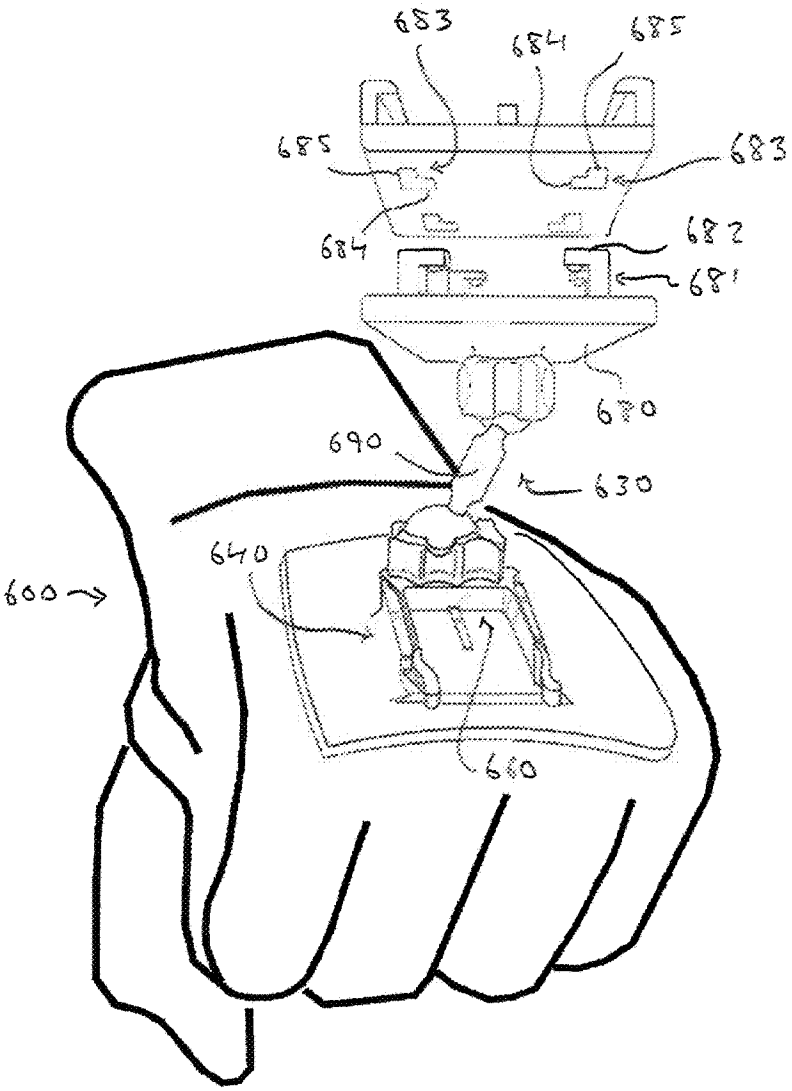

Referring additionally to FIGS. 12A and 12B, although the platform 680 may include any of the previously discussed means of retaining items thereon, the platform 680 preferably includes a plurality of retention legs 681, each having a retention tab 682 that is selectively receivable in a corresponding retention slot 683 formed in the bottom of an item to be mounted thereon. As shown, each retention leg 681 extends upwardly therefrom, and includes a retention tab 682 extending inwardly therefrom at its distal end. Each corresponding retention slot 683 includes a wide first portion 684 through which a corresponding retention tab 682 is received, and a second narrow portion 685 that is more narrow than the corresponding retention tab 682. As such, after passing a retention tab 682 through the wide first portion 684, when the user slides the narrow second portion under the retention tab 682, the item is retained on the platform 680 until similarly removed therefrom.

While one or more preferred embodiments of the invention are described above, it should be appreciated by those skilled in the art that various modifications and variations can be made in the present invention without departing from the scope and spirit thereof. It is intended that the present invention cover such modifications and variations as come within the scope and spirit of the appended claims and their equivalents.

The invention claimed is:

1. A utility glove including a retention assembly, the glove being configured to be worn on a hand of a user, comprising:

a body portion including a palm covering and a dorsal covering, the body portion defining a wrist opening and a plurality of digit apertures; and a retainer assembly comprising:

a base portion disposed on an outer surface of the dorsal covering, the base portion including a body portion defining a circular aperture defined by a cylindrical inner wall of the base portion, and a platform portion including a cylindrical body portion that is selectively insertable into and rotatably disposed within the circular aperture of the base portion, the platform portion including a retention portion for selectively retaining items thereon;

wherein the cylindrical inner wall of the base portion defines an annular groove therein, and the platform portion includes a pair of opposed tabs that are extendable radially-outwardly therefrom into the annular groove, wherein the tabs are slidable within the annular groove.

2. The glove as in claim 1, wherein the retention portion comprises one of a magnetic surface, a pouch, a drill bit holder, a bungee strap, a socket holder, and a stick pad.

3. The glove as in claim 2, wherein the retention portion is releasably secured to an upper portion of the platform portion by a hook and loop fastener.

4. The glove as in claim 2, wherein the retention portion is magnetically secured to the platform portion of the retention assembly.

5. The glove as in claim 1, wherein the tabs are movable between a first position in which they extend radially-outwardly from the cylindrical body portion, and a second position in which the tabs are disposed within the cylindrical body portion.

6. The glove as in claim 1, further including a plurality of digit sleeves, each digit sleeve extending from a corresponding digit aperture of the body portion and being configured to slidably receive a digit of the user's hand therein.

* * * * *